US009400140B2

(12) United States Patent
Hicks et al.

(10) Patent No.: US 9,400,140 B2
(45) Date of Patent: Jul. 26, 2016

(54) COOLING TOWER WITH AUTOMATIC HYDRAULIC BALANCING

(71) Applicants: Philip Clayton Hicks, Humble, TX (US); Mark Lewis Merrifield, Houston, TX (US)

(72) Inventors: Philip Clayton Hicks, Humble, TX (US); Mark Lewis Merrifield, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 200 days.

(21) Appl. No.: 14/285,714

(22) Filed: May 23, 2014

(65) Prior Publication Data

US 2014/0367872 A1 Dec. 18, 2014

Related U.S. Application Data

(60) Provisional application No. 61/834,030, filed on Jun. 12, 2013.

(51) Int. Cl.
*B01F 3/04* (2006.01)
*F28C 1/02* (2006.01)

(52) U.S. Cl.
CPC ..... *F28C 1/02* (2013.01); *B01F 3/04049* (2013.01); *B01F 3/04078* (2013.01)

(58) Field of Classification Search
CPC .... B01F 3/04; B01F 3/04021; B01F 3/04049; B01F 3/04078
USPC ..... 261/111, DIG. 11
See application file for complete search history.

(56) References Cited

U.S. PATENT DOCUMENTS

| | | | | |
|---|---|---|---|---|
| 2,732,190 | A | 1/1956 | Mart | |
| 3,243,166 | A | 3/1966 | Osenga et al. | |
| 3,322,409 | A | 5/1967 | Reed | |
| 3,794,304 | A * | 2/1974 | Cates | F28C 1/12 251/61 |
| 4,032,604 | A | 6/1977 | Parkinson et al. | |
| 4,315,873 | A | 2/1982 | Smith et al. | |
| 4,476,070 | A | 10/1984 | Blanquet | |
| 2011/0241232 | A1 | 10/2011 | Daley et al. | |

FOREIGN PATENT DOCUMENTS

| | | | |
|---|---|---|---|
| FR | 522787 | A | 8/1921 |
| FR | 2266134 | A1 | 10/1975 |

OTHER PUBLICATIONS

European Application No. EP 13 17 5359.2-1605, Communication from the European Patent Office, EPO Form 1507N06.12, dated Feb. 5, 2014, 11 pages.

* cited by examiner

*Primary Examiner* — Robert A Hopkins
(74) *Attorney, Agent, or Firm* — Andrew T. Ward

(57) ABSTRACT

A cooling tower including a hot-water basin comprising a first cooling cell and a second cooling cell; and at least one means for controlling fluid communication between the first and second cooling cells is provided. A method of maintaining the efficiency of a cooling tower and a method of servicing a cooling tower are also provided.

21 Claims, 4 Drawing Sheets

COOLING TOWER WITH AUTOMATIC HYDRAULIC BALANCING

CROSS REFERENCE TO RELATED APPLICATION

This application relates and claims priority to U.S. Provisional Application No. 61/834,030, filed on Jun. 12, 2013.

FIELD

The present disclosure relates to liquid cooling towers, and more particularly, to liquid cooling towers that include a plurality of cooling cells.

BACKGROUND

Cooling towers are used to cool liquid by contact with air. The liquid is allowed to flow downwardly through the tower, and a countercurrent flow of air is drawn through the falling liquid by various means. A common application of liquid cooling towers is to cool water used in electrical generating systems, process plants and industrial and institutional air conditioning systems, to dissipate waste heat.

Current multi-cell, induced draft, cross flow cooling towers are constructed modularly, with hydraulically isolated hot-water basins (also referred to as "cooling cells") that contain the water to be cooled. The water is cooled in the cooling tower internal cooling structures as it falls to a common cold-water basin beneath the tower. In order to operate efficiently, even distribution of the water between cooling cells is required in order to prevent any one cell from becoming overloaded. If excess water is directed to one cell of the cooling tower, it will not be possible to cool the flow as efficiently. As a result, both the off-tower temperature and the approach-temperature will be higher than the design values for a given tower.

Cooling cells can reach imbalance in a variety of different ways, including blockages in the spray nozzles that drain the hot-water basin. The current practice to correct imbalance in a cooling tower is to control the flow of water through the cooling water lines until basin depth is uniform across the cooling cells. Because this process is tedious, it is not always conducted. Thus, in many cases, cooling cell imbalances are tolerated and efficiency is sacrificed.

Therefore, what is needed is a cost-effective solution to solve the problem of cell-to-cell imbalance that would maintain and improve cooling tower efficiency.

SUMMARY

In one aspect, embodiments described herein, provide cooling tower comprising: (a) a hot-water basin comprising a first cooling cell and a second cooling cell; and (b) at least one means for controlling fluid communication between the first and second cooling cells. In particular embodiments, the means is selected from the group consisting of a valve, a movable divider, or a gate, located e.g., between the first and second cooling cells is located in said at least one common wall.

Some cooling towers described herein may be described as comprising: (a) two or more cooling cells, each cooling cell comprising at least one side wall, said at least one side wall having at least one passage there through in fluid communication with an adjacent cooling cell; and (b) at least one valve positioned within said at least one passage for opening and closing said at least one passage.

In another aspect, embodiments described herein provide a method of maintaining the efficiency of a cooling tower, comprising: providing a hot-water basin comprising two or more cooling cells, said two or more cooling cells having means for providing fluid communication therebetween; and operating said means to provide fluid communication therebetween said two or more cooling cells. Particular embodiments may further comprise providing fluid communication between the hot-water basin and a cold-water basin, determining the location of an inefficient cooling cell and closing said means to hydraulically isolate said inefficient cooling cell. Still other embodiments may further comprise servicing the inefficient cooling cell, and opening said means to return said inefficient cooling cell to fluid communication.

In still another aspect, embodiments described herein provide a method of servicing a cooling tower, the cooling tower having a two or more cooling cells, each cooling cell in fluid communication with adjacent cooling cells via one or more valves, the method comprising: determining the location of an inefficient cooling cell; closing the one or more valves to isolate the inefficient cooling cell for service; servicing the inefficient cooling cell; opening the one or more valves; and placing the cooling cell back in operation.

BRIEF DESCRIPTION OF THE DRAWINGS

The embodiments disclosed herein are illustrated by way of example, and not by way of limitation, in the figures of the accompanying drawings.

DETAILED DESCRIPTION

Figure 1:
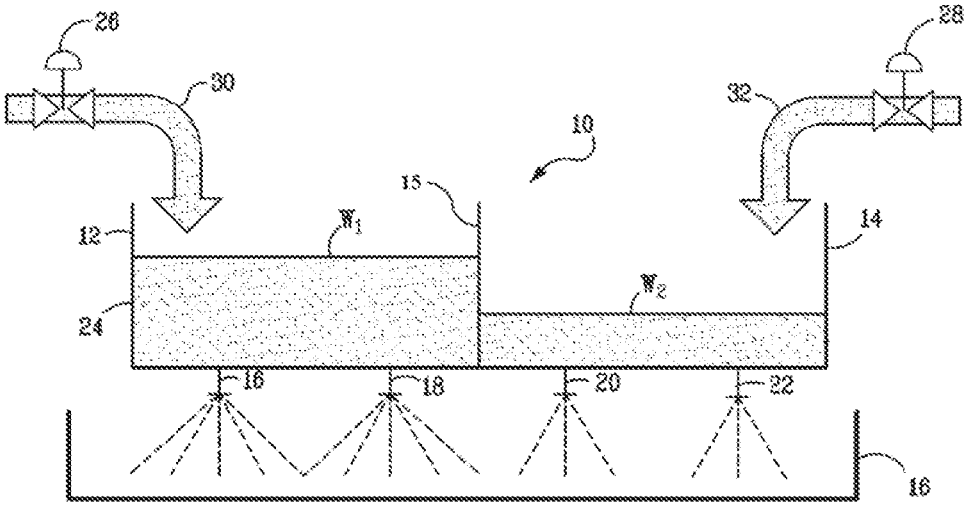
FIG. 1 presents a schematic view of a typical multi-cell cooling tower and illustrates problems associated therewith.
Figure 2:
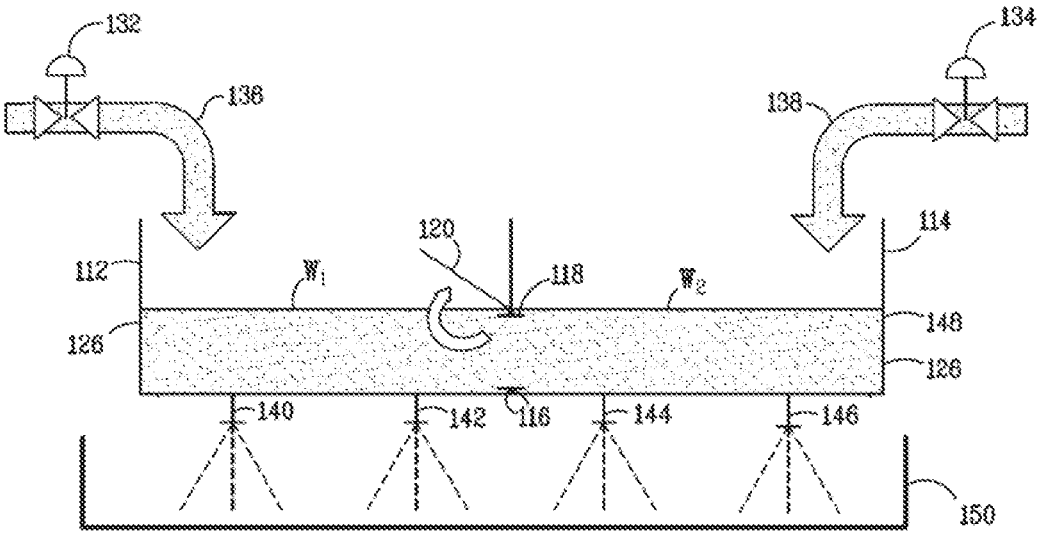
FIG. 2 presents, schematically, an illustrative, non-exclusive example of a multi-cell cooling tower, according to the present disclosure.
Figure 2A:
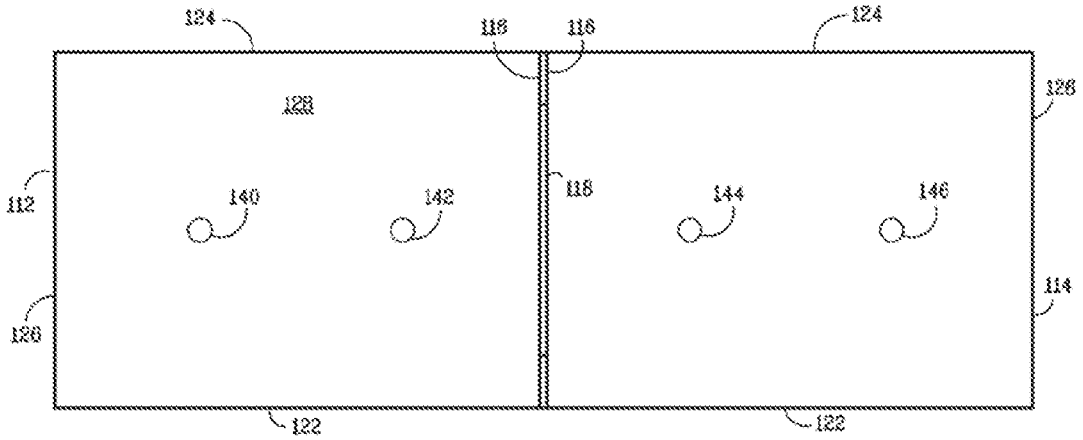
FIG. 2A presents, schematically, a top plan view of the multi-cell cooling tower of FIG. 2, according to the present disclosure.
Figure 3:
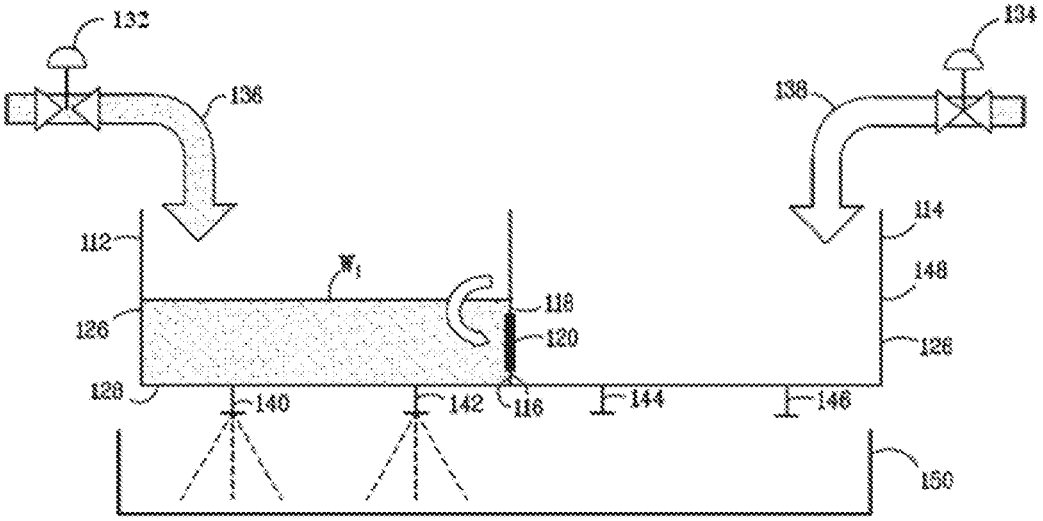
FIG. 3 presents, schematically, an illustrative, non-exclusive example of a multi-cell cooling tower configured in a maintenance mode, according to the present disclosure.
Figure 4:
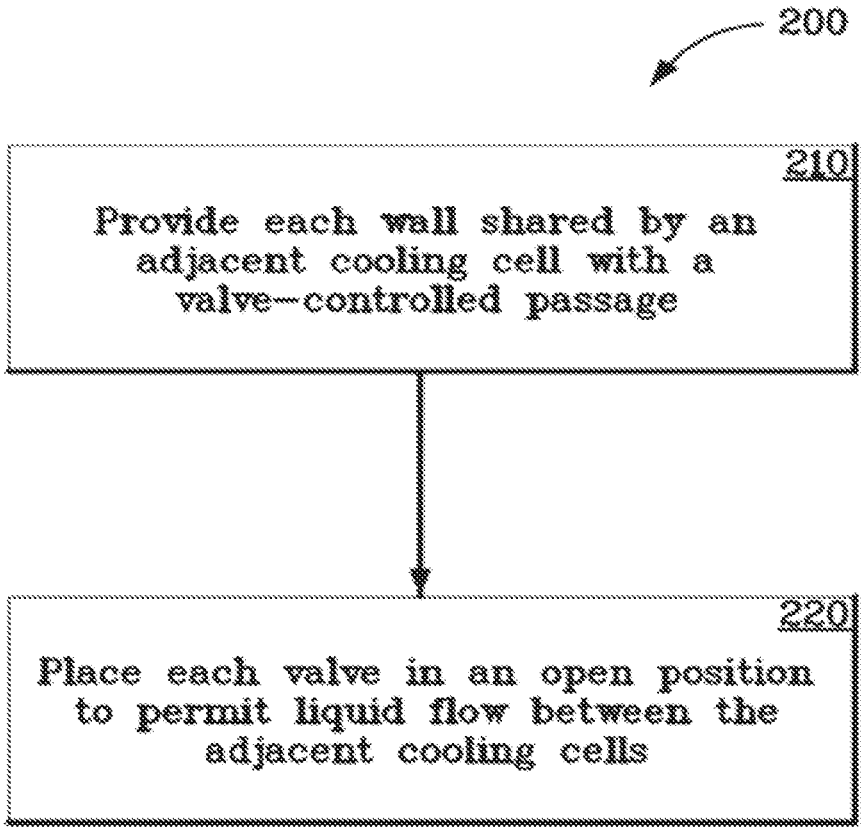
FIG. 4 presents a flowchart showing illustrative, non-exclusive examples of methods of maintaining the efficiency of multi-cell cooling towers, according to the present disclosure.
Figure 5:
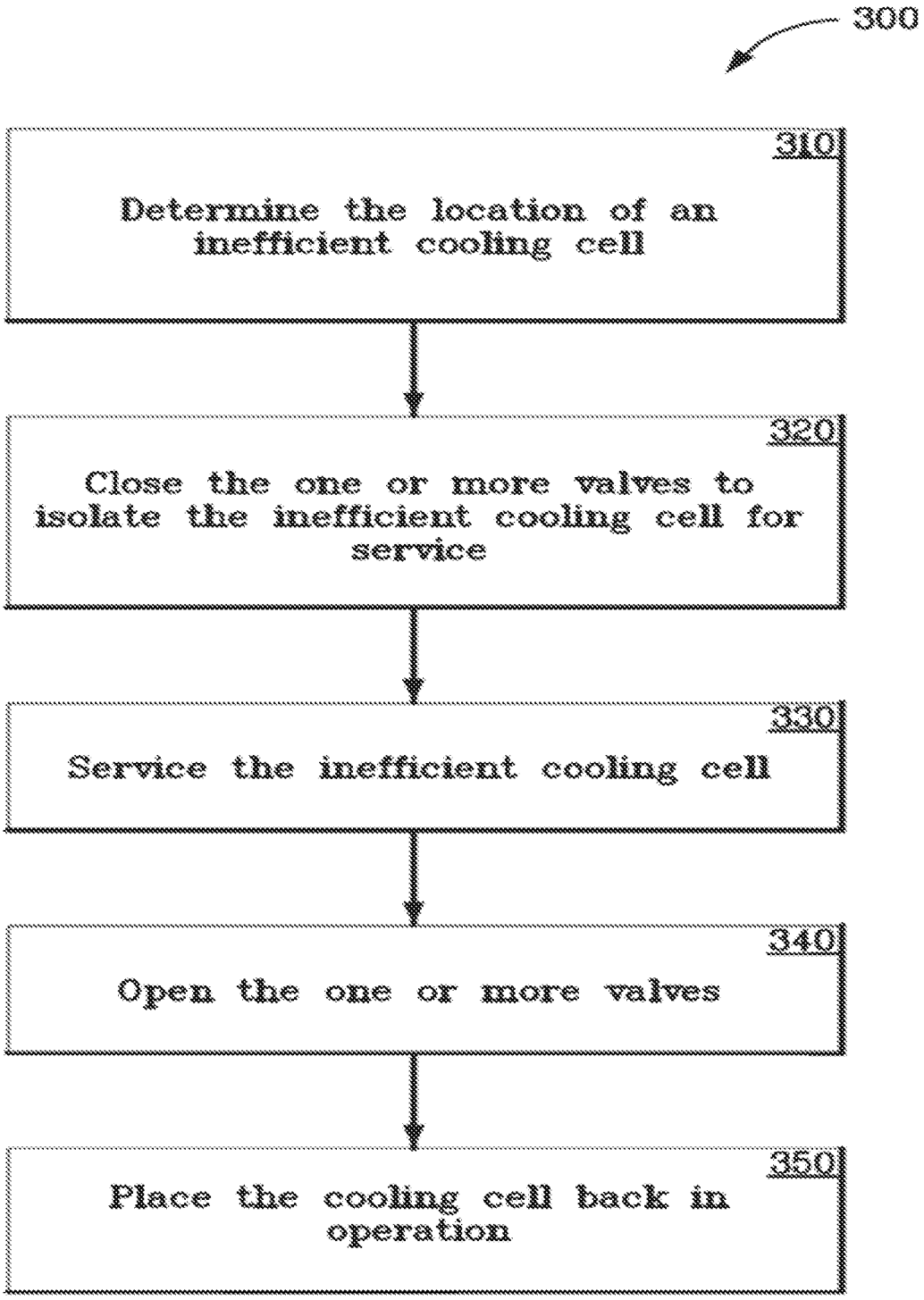
FIG. 5 presents a flowchart showing illustrative, non-exclusive examples of methods of servicing multi-cell cooling towers, according to the present disclosure.

FIG. 1 presents a schematic view of a typical cooling tower and illustrates a problem associated with hot-water basins thereof. FIGS. 2, 2A and 3 provide illustrative, non-exclusive examples of cooling towers, according to the present disclosure and/or of systems, apparatus, and/or assemblies that may include, be associated with, be operatively attached to, and/or utilize such cooling towers. In FIGS. 2, 2A and 3, like numerals denote like, or similar, structures and/or features; and each of the illustrated structures and/or features may not be discussed in detail herein with reference to FIGS. 2, 2A and 3. Similarly, each structure and/or feature may not be explicitly labeled in FIGS. 2, 2A and 3; and any structure and/or feature that is discussed herein with reference to FIGS. 2, 2A and 3 may be utilized with any other structure and/or feature without departing from the scope of the present disclosure. FIG. 4 presents a flowchart showing illustrative, non-exclusive examples of methods of maintaining the efficiency of cooling towers, and may be utilized with any structure and/or feature without departing from the scope of the present disclosure. FIG. 5 presents a flowchart showing illustrative, non-exclusive examples of methods of servicing cooling towers, and may be utilized with any structure and/or feature without departing from the scope of the present disclosure.

In general, structures and/or features that are, or are likely to be, included in a given embodiment are indicated in solid lines in FIGS. 2 through 5, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Current induced draft, cross-flow cooling towers having more than one cell in the hot-water basin are generally constructed in a modular manner. Referring to FIG. 1, a schematic view of such a conventional cooling tower 10 is presented. In cooling tower 10, to avoid the need to take the entire tower offline for servicing, water to be cooled is hydraulically isolated, e.g., by a solid divider such as common wall 15, within individual cooling cells 12 and 14 of the hot-water basin 24. The hot water falls to cold-water basin 16 located beneath cooling tower 10. In order to operate efficiently, even distribution of the water between cooling cells 12 and 14 is required in order to prevent any one cell from becoming overloaded. If, as shown, excess water is directed to cell 12 of cooling tower 10, it will not be possible to cool the water flow as efficiently. As a result, both the off-tower temperature and the approach temperature will be higher than the design values for tower 10.

Cooling cells can reach imbalance in a variety of different ways, including, as shown in FIG. 1, blockages in one or more spray nozzles 16, 18, 20 and 24 that drain hot-cooling cells 12 and 14. As shown in a representational manner, spray nozzles 16 and 18 are partially blocked, leading to the higher water level $W_1$ shown for cell 14. Because the cooling cells 12 and 14 are hydraulically isolated in the conventional design of cooling tower 10, the current practice to correct imbalance between cooling cells 12 and 14 is to throttle each of the valves 26 and/or 28 on cooling water lines 30 and/or 32 until basin depth is uniform across cooling cells 12 and 14. As may be appreciated by those skilled in the art, this process can be tedious, and is not always conducted. In many cases, cooling towers designed in this manner are allowed to operate with an imbalance and efficiency is sacrificed.

Referring now to FIG. 2 a schematic view of an illustrative, non-exclusive example of a cooling tower 100, according to the present disclosure, is shown. As shown, cooling tower 100 includes a plurality of cooling cells 112 and 114, each cooling cell 112 and 114 comprising at least one side wall, 116, at least one side wall, 116 having at least one passage 118, therethrough in fluid communication with an adjacent cooling cell 112 or 114. Cooling tower 100 further includes at least one means 120 for controlling fluid communication between the cooling cells positioned within at least one passage 118 for at least partially opening and closing at least one passage 118.

The cooling cells 112 and 114 of cooling tower 100 taken together, are structured and arranged to form hot-water basin 148. Hot-water basin 148 is in fluid communication with cold-water basin 150. In some embodiments, cold-water basin 150 is fed by a plurality of spray nozzles, 140, 142, 144 and 146. In some embodiments, each cooling cell 112 and 114 has at least one spray nozzle. In some embodiments, cooling tower 100 is an induced draft, cross-flow cooling tower.

Referring now to FIG. 2A, in some embodiments, each cooling cell 112 and 114 includes a first pair of generally parallel side walls 122 and 124 and a second pair of generally parallel side walls 118 and 126, the first pair of generally parallel side walls 122 and 124 and the second pair of generally parallel side walls 118 and 126 structured and arranged to form cooling cells 112 and 114. In some embodiments, the side walls 116 of adjacent cooling cells 112 and 114, are shared and each shared side wall 116 has a passage 118 in fluid communication with adjacent cooling cell 112 and 114.

As may be appreciated, the provision of passage 118 serves to overcome the problem of uneven distribution of water between cooling cells 112 and 114, mitigating the overload of any one of cells 112 and 114. In some embodiments, auto-balancing valves 120 are installed in passage 118 between adjacent cooling cells 112 and 114. In some embodiments, each passage 118 has a valve 120 for opening and closing passage 118. Other means for controlling fluid communication between the cooling cells include, e.g., a movable divider or a gate. Opening valve 120 between cooling cells 112 and 114 hydraulically links them, and thereby corrects discrepancies in basin levels $W_1$ and $W_2$, by allowing water to flow back and forth.

As may be appreciated, the response to opening valve 120 is substantially immediate, and does not require the iterative control of valves 132 and/or 134 on cooling water lines 136 and/or 138 to provide uniform water depth, and is uniform across cooling cells 112 and 114 of hot-water basin 148. This is true even in the case where one or more spray nozzles 140, 142, 144 and/or 146 become blocked.

In some embodiments, each means 120 is adjustable to permit liquid flow between the plurality of cooling cells 112 and 114. As may be appreciated, means 120 may be selected from a wide variety of valve-, divider-, and gate-type devices. In some embodiments, valve 120 is a gate valve.

Despite the afore-mentioned benefits accruing from the provision of passage 118 and means 120, the need to hydraulically isolate cooling cells may still arise. One example of such a case is in the event that a cooling cell must be taken out of service for routine inspection and maintenance.

Referring now to FIG. 3, an illustrative, non-exclusive example of a cooling tower 100 configured in a maintenance mode, is presented. As shown, to place cooling tower 100 in maintenance mode, an auto-balancing valve 120 is placed in a closed position and the cooling water supply valve 134 is closed to stop the flow of cooling water from cooling water line 138 to cooling cell 114. The water in cell 114 is allowed to drain from cooling cell 114 until substantially empty. At this point, spray nozzles 144 and 146 may be cleaned or replaced or any other maintenance performed. Cooling cell 114 may be placed back in service by opening valve 120 to hydraulically link cooling cells 112 and 114 and opening cooling water supply valve 134 to establish the flow of cooling of cooling water from cooling water line 138 to cooling cell 114.

Referring now to FIG. 4, a flowchart showing illustrative, non-exclusive examples of methods of maintaining the efficiency of a cooling tower 200, is presented. The method of maintaining the efficiency of a multi-cell cooling tower 200, includes the step 210 of providing each wall shared by an adjacent cooling cell with a valve-controlled passage; and the step 220 of placing each valve in an open position to permit liquid flow between the adjacent cooling cells. As indicated, by installing auto-balancing valves between cooling cells, it will be possible to eliminate the need to perform a manual balance of a cooling tower to maintain efficiency. In some embodiments, each valve is a gate valve.

In some embodiments, the method 200 further comprises the steps of determining the location of an inefficient cooling cell and closing one or more valves to isolate the inefficient cooling cell for service.

In some embodiments, the method 200 further comprises the steps of servicing the inefficient cooling cell, opening the one or more valves and placing the cooling cell back in operation.

In some embodiments, the cooling cells are structured and arranged to form a hot-water basin. In some embodiments, the hot-water basin is in fluid communication with a cold-water basin. In some embodiments, the cold-water basin is fed by a plurality of spray nozzles.

Referring now to FIG. 5, a flowchart showing illustrative, non-exclusive examples of methods of servicing a cooling tower 300, is presented. The method of servicing a cooling tower 300 is adapted to a cooling tower having a plurality of cooling cells, each cooling cell in fluid communication with adjacent cooling cells via one or more fluid communication means, e.g. valve-, divider- and/or gate-type devices. The method 300 includes the steps of determining the location of an inefficient cooling cell, identified as step 310; closing the one or more valves to isolate the inefficient cooling cell for service, identified as step 320; servicing the inefficient cooling cell, identified as step 330; opening the one or more valves, identified as step 340; and placing the cooling cell back in operation, identified as step 350. In some embodiments, each valve is a gate valve.

The cooling towers and methods disclosed herein may provide a significant means for reducing operating costs for cooling towers. The cooling towers and methods disclosed herein take advantage of hydraulically linking individual cooling cells of a cooling tower to overcome the problem of uneven distribution of water between cooling cells, preventing cooling cells from becoming overloaded.

In the present disclosure, several of the illustrative, non-exclusive examples have been discussed and/or presented in the context of schematic drawings, in which the methods are shown and described as a series of blocks, or steps. Unless specifically set forth in the accompanying description, it is within the scope of the present disclosure that the order of the blocks may vary from the illustrated order in the flow diagram, including two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present, other than the entities specifically identified, by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least on of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Each of the following terms: "includes," "including," "has," "having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the embodiments disclosed herein, and is not to be understood or construed as inflexibly limiting the scope of the embodiments disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

PARTICULAR EMBODIMENTS

Illustrative, non-exclusive examples of cooling towers and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

Embodiment A

A cooling tower comprising: (a) a hot-water basin comprising a first cooling cell and a second cooling cell; and (b) at least one means for controlling fluid communication between the first and second cooling cells.

Embodiment B

The cooling tower of Embodiment A, wherein said means is selected from the group consisting of a valve, a movable divider, or a gate.

Embodiment C

The cooling tower of Embodiment A or B, wherein the first cooling cell comprises one or more side walls A structured and arranged to form said first cooling cell and the second cooling cell comprises one or more side walls B structured and arranged to form said second cooling cell.

Embodiment D

The cooling tower of Embodiment C, wherein said one or more side walls A comprise a first pair of generally parallel side walls and a second pair of generally parallel side walls, said first and second pairs of generally parallel side walls and said one or more side walls B comprises a third pair of generally parallel side walls and a fourth pair of generally parallel side walls.

Embodiment E

The cooling tower of Embodiment C, wherein the hot-water basin comprises at least one common wall formed from at least one of the one or more side walls A of the first cooling cell and at least one of the one or more side walls B of the second cooling cell.

Embodiment F

The cooling tower of Embodiment E, wherein the means for controlling fluid communication between the first and second cooling cells is located in said at least one common wall.

Embodiment G

The cooling tower of any of Embodiments A-F, wherein said hot-water basin is in fluid communication with a cold-water basin.

Embodiment H

The cooling tower of any of Embodiments G, wherein each of the first and second cooling cells further comprises at least one spray nozzle in fluid communication with said cold-water basin.

Embodiment I

The cooling tower of any of Embodiments A-H, wherein the cooling tower is an induced draft cross-flow cooling tower.

Embodiment J

A method of maintaining the efficiency of a cooling tower, comprising: providing a hot-water basin comprising two or more cooling cells, said two or more cooling cells having means for providing fluid communication therebetween; and operating said means to provide fluid communication therebetween said two or more cooling cells.

Embodiment K

The method of Embodiment J, wherein said means is a valve, a movable divider, or a gate.

Embodiment L

The method Embodiment J or K, wherein said hot-water basin comprises from 2 to 10 cooling cells.

Embodiment M

The method of Embodiments J-L, further comprising providing fluid communication between the hot-water basin and a cold-water basin.

Embodiment N

The method of Embodiment M, wherein a plurality of spray nozzles provides said fluid communication between the hot-water basin and a cold-water basin.

Embodiment O

The method of any of Embodiments J-N, further comprising the steps of determining the location of an inefficient cooling cell and closing said means to hydraulically isolate said inefficient cooling cell.

Embodiment P

The method of Embodiment O, further comprising the steps of servicing the inefficient cooling cell, and opening said means to return said inefficient cooling cell to fluid communication.

Embodiment Q

A method of servicing a cooling tower, the cooling tower having a two or more cooling cells, each cooling cell in fluid communication with adjacent cooling cells via one or more valves, the method comprising: determining the location of an inefficient cooling cell; closing the one or more valves to isolate the inefficient cooling cell for service; servicing the inefficient cooling cell; opening the one or more valves; and placing the cooling cell back in operation.

Embodiment R

The method of Embodiment Q, wherein each valve is a gate valve.

Embodiment S

A cooling tower comprising: (a) two or more cooling cells, each cooling cell comprising at least one side wall, said at least one side wall having at least one passage therethrough in fluid communication with an adjacent cooling cell; and (b) at least one valve positioned within said at least one passage for opening and closing said at least one passage.

Embodiment T

The cooling tower of Embodiment S, wherein each cooling cell comprises a first pair of generally parallel side walls and a second pair of generally parallel side walls, said first and second pairs of generally parallel side walls structured and arranged to form said cooling cell.

Embodiment U

The cooling tower of Embodiment T, wherein said side walls of adjacent cooling cells are shared and each of said shared side walls have a passage in fluid communication with said adjacent cooling cell.

Embodiment V

The cooling tower of Embodiment U, wherein each passage has a valve for opening and closing said passage.

Embodiment W

The cooling tower of Embodiment V, wherein each valve is adjustable to permit liquid flow between said two or more of cooling cells.

Embodiment X

The cooling tower of any of Embodiments S-W, wherein said at least one valve is a gate valve.

Embodiment Y

The cooling tower of any of Embodiments S-X, wherein said two or more cooling cells are structured and arranged to form a hot-water basin.

Embodiment Z

The cooling tower of Embodiment Y, wherein said hot-water basin is in fluid communication with a cold-water basin.

Embodiment AA

The cooling tower of Embodiment Z, wherein said cold-water basin is fed by a plurality of spray nozzles.

Embodiment AB

The cooling tower of any of Embodiments S-AA, wherein the cooling tower is an induced draft cross-flow cooling tower.

INDUSTRIAL APPLICABILITY

The cooling towers and methods disclosed herein are applicable to any facility or industry where cooling towers may be employed.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. For example, while the embodiments herein have been described with reference to cooling towers having two cooling cells, it will be appreciated that any number of cooling cells could be used (e.g., 2 to 20, 2 to 10, 4 to 20, 4 to 10, etc.). And while the benefits of the invention may be most effectively realized where all cooling cells are in direct or indirect fluid communication, any number of might be isolated for one reason or another. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

All documents described herein, including any priority documents and/or testing procedures to the extent they are not inconsistent with this text are incorporated by reference herein for all jurisdictions in which such incorporation is permitted, provided, however, that any priority document not named in the initially filed application or filing documents is NOT incorporated by reference herein. In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

The term "comprising" is considered synonymous with the term "including" for purposes of Australian law. Likewise, whenever a claim element or a group of elements is preceded with the transitional phrase "comprising", it is understood that we also contemplate the same claim element or group of elements with transitional phrases "consisting essentially of", "consisting of", "selected from the group of consisting of" or "is" preceding the recitation of the composition, element, or elements and vice versa. In addition, the embodiments of the cooling towers methods described herein may lack any additional component, feature, or step not expressly recited.

The invention claimed is:

1. A cooling tower comprising:

(a) a hot-water basin comprising a first cooling cell and a second cooling cell; and (b) at least one means for controlling fluid communication between the first and second cooling cells;

wherein the first cooling cell comprises one or more side walls A structured and arranged to form said first cooling cell and the second cooling cell comprises one or more side walls B structured and arranged to form said second cooling cell; wherein the means for controlling fluid communication between the first and second cooling cells is located in said common wall.

2. The cooling tower of claim 1, wherein said means is selected from the group consisting of a valve, a movable divider, or a gate.

3. The cooling tower of claim 1, wherein said one or more side walls A comprise a first pair of generally parallel side walls and a second pair of generally parallel side walls, said first and second pairs of generally parallel side walls and said one or more side walls B comprises a third pair of generally parallel side walls and a fourth pair of generally parallel side walls.

4. The cooling tower of claim 1, wherein the hot-water basin comprises at least one common wall formed from at least one of the one or more side walls A of the first cooling cell and at least one of the one or more side walls B of the second cooling cell.

5. The cooling tower of claim 1, wherein said hot-water basin is in fluid communication with a cold-water basin.

6. The cooling tower of claim 5, wherein each of the first and second cooling cells further comprises at least one spray nozzle in fluid communication with said cold-water basin.

7. The cooling tower of claim 1, wherein the cooling tower is an induced draft cross-flow cooling tower.

8. A method of maintaining the efficiency of a cooling tower, comprising:

providing a hot-water basin comprising two or more cooling cells, said two or more cooling cells having means for providing fluid communication therebetween; and operating said means to provide fluid communication therebetween said two or more cooling cells;

wherein the two or more cooling cells comprise a first cooling cell and a second cooling cell; wherein the first cooling cell comprises one or more side walls A structured and arranged to form said first cooling cell and the second cooling cell comprises one or more side walls B structured and arranged to form said second cooling cell; wherein the means to provide fluid communication therebetween the first and second cooling cells is located in said common wall.

9. The method of claim 8, wherein said means is a valve, a movable divider, or a gate.

10. The method of claim 8, further comprising providing fluid communication between the hot-water basin and a cold-water basin.

11. The method of claim 8, wherein a plurality of spray nozzles provides fluid communication between the hot-water basin and a cold-water basin.

12. The method of claim 8, further comprising the steps of determining the location of an inefficient cooling cell of the two or more cooling cells and closing said means to hydraulically isolate said inefficient cooling cell.

13. The method of claim 12, further comprising the steps of servicing the inefficient cooling cell, and opening said means to return said inefficient cooling cell to fluid communication.

14. A cooling tower comprising:

(a) two or more cooling cells, each cooling cell comprising at least one side wall, said at least one side wall having at least one passage therethrough in fluid communication with an adjacent cooling cell; and (b) at least one valve positioned within said at least one passage for opening and closing said at least one passage.

15. The cooling tower of claim 14, wherein each cooling cell comprises a first pair of generally parallel side walls and a second pair of generally parallel side walls, said first and second pairs of generally parallel side walls structured and arranged to form said cooling cell.

16. The cooling tower of claim 15, wherein said side walls of adjacent cooling cells are shared and each of said shared side walls have a passage in fluid communication with said adjacent cooling cell.

17. The cooling tower of claim 16, wherein each passage has a valve for opening and closing said passage.

18. The cooling tower of claim 17, wherein each valve is adjustable to permit liquid flow between said two or more of cooling cells.

19. The cooling tower of claim 14, wherein said at least one valve is a gate valve.

20. The cooling tower of claim 14, wherein said two or more cooling cells are structured and arranged to form a hot-water basin.

21. The cooling tower of claim 20, wherein said hot-water basin is in fluid communication with a cold-water basin.

* * * * *